US006133146A

United States Patent [19]

Martinez-Tovar et al.

[11] Patent Number: 6,133,146

[45] Date of Patent: Oct. 17, 2000

[54] SEMICONDUCTOR BRIDGE DEVICE AND METHOD OF MAKING THE SAME

[75] Inventors: Bernardo Martinez-Tovar; John A. Montoya, both of Albuquerque, N. Mex.

[73] Assignee: SCB Technologies, Inc., Albuquerque, N. Mex.

[21] Appl. No.: 08/644,008

[22] Filed: May 9, 1996

[51] Int. Cl.[7] ..... H07L 21/44

[52] U.S. Cl. ..... 438/656; 438/614; 102/202.3; 102/202.4

[58] Field of Search ..... 102/102.1–102.5; 438/614, 656

[56] References Cited

U.S. PATENT DOCUMENTS

| | | | |
|---|---|---|---|
| 39,542 | 8/1863 | Beardslee . | |
| 722,913 | 3/1903 | Schmitt et al. . | |
| 2,942,546 | 6/1960 | Liebhafsky et al. . | |
| 3,108,905 | 10/1963 | Comer . | |
| 3,196,041 | 7/1965 | McNulty et al. . | |
| 3,249,800 | 5/1966 | Huber . | |
| 3,366,055 | 1/1968 | Hollander, Jr. . | |
| 3,426,682 | 2/1969 | Corren et al. . | |
| 3,618,523 | 11/1971 | Hiquera . | |
| 3,669,022 | 6/1972 | Dahn et al. . | |
| 3,725,671 | 4/1973 | Keister et al. . | |
| 3,763,782 | 10/1973 | Bendler et al. . | |
| 3,882,323 | 5/1975 | Smolker . | |
| 3,883,762 | 5/1975 | Harris et al. . | |
| 3,974,424 | 8/1976 | Lee . | |
| 4,312,271 | 1/1982 | Day et al. . | |
| 4,337,408 | 6/1982 | Sone et al. . | |
| 4,471,697 | 9/1984 | McCormick et al. . | |
| 4,708,060 | 11/1987 | Bickes, Jr. et al. . | |
| 4,819,560 | 4/1989 | Patz et al. . | |
| 4,976,200 | 12/1990 | Bensen et al. . | |
| 5,090,322 | 2/1992 | Allford . | |
| 5,166,468 | 11/1992 | Atkeson | 102/207 |
| 5,173,449 | 12/1992 | Lorenzen et al. | 437/192 |
| 5,179,248 | 1/1993 | Hartman et al. | 102/202.4 |
| 5,309,841 | 5/1994 | Hartman et al. . | |
| 5,355,800 | 10/1994 | Dow et al. | 102/202.4 |
| 5,370,054 | 12/1994 | Reams et al. . | |
| 5,376,585 | 12/1994 | Lin et al. | 437/192 |
| 5,385,097 | 1/1995 | Hruska et al. . | |
| 5,415,932 | 5/1995 | Bishop et al. . | |
| 5,431,101 | 7/1995 | Arrell, Jr. et al. | 102/202.5 |
| 5,439,847 | 8/1995 | Chittipeddi et al. | 438/656 |
| 5,484,747 | 1/1996 | Chien . | |
| 5,503,077 | 4/1996 | Motley | 102/202.5 |

FOREIGN PATENT DOCUMENTS

| | | |
|---|---|---|
| 960186 | 9/1962 | United Kingdom . |

OTHER PUBLICATIONS

Thick Tungsten Films In Multilayer Conductor Systems: Properties And Deposition Techniques, Blewer et al, 1984 Proceedings First Int'l IEEE VLSI Multilevel Interconnection Conference, Jun. 21–22, 1984, pp. 153–158.

*Primary Examiner*—Kevin M. Picardat
*Attorney, Agent, or Firm*—Libert & Associates

[57] ABSTRACT

A device, e.g., an explosive-initiation device (24) includes a semiconductor bridge device (10) comprising semiconductor pads (14*a*, 14*b*) separated by an initiator bridge (14*c*) and having metallized lands (16*a*, 16*b*) disposed over the pads (14*a*, 14*b*). The metallized lands (16*a*, 16*b*) each comprise a titanium base layer (18), a titanium-tungsten intermediate layer (20) and a tungsten top layer (22). This multilayer construction is simple to apply, provides good adhesion to the semiconductor (14) and enhanced semiconductor bridge characteristics, and avoids the electromigration problems attendant upon use of aluminum metallized lands under severe conditions of no-fire tests and very low firing voltage or current levels. The semiconductor (14) may optionally be covered by a cap or cover (117) of a stratified metal layer similar or identical to the metallized lands (16*a*, 16*b*). A method of making the semiconductor bridge devices includes metal sputtering of titanium, then titanium plus tungsten and then tungsten onto an appropriately masked semiconductor surface to attain the multilayer metallized lands (16*a*, 16*b*) and/or cover (117) of the invention.

36 Claims, 6 Drawing Sheets

SEMICONDUCTOR BRIDGE DEVICE AND METHOD OF MAKING THE SAME

BACKGROUND OF THE INVENTION

1. Field of the Invention

The present invention is concerned with semiconductor bridge igniters, which are useful in initiating the detonation of explosives. In particular, the present invention is concerned with semiconductor bridge devices employing multilayer metallized lands and/or a multilayer metallized bridge, which devices provide greatly improved performance characteristics as compared to prior art devices, and with a method of making the same.

2. Related Art

U.S. Pat. No. 4,708,060 of R. W. Bickes, Jr. et al, entitled "Semiconductor Bridge (SCB) Igniter", issued on Nov. 24, 1987, discloses a structure comprising a semiconductor or other suitable "electrical material" supported upon a non-electrically-conducting substrate and having metallized lands formed thereon. The electrical material must, according to the Bickes et al patent, (column 3, line 41 et seq.) develop a temperature coefficient of electrical resistivity which is negative at some temperature, for example, some temperature above room temperature, such as about 100° C. Bickes et al teaches (column 3, line 19 et seq.) that the precise temperature is not critical and that essentially all semiconductors will have this property at sufficiently high doping levels, as will some other materials, such as rare earth metal oxides (column 3, line 54 et seq.). Preferred doping levels for semiconductors are preferably essentially at or near the saturation level, for example, approximately $10^{19}$ atoms per cubic centimeter. A typical doping component would be phosphorus atoms used for doping n-type silicon. Lower doping levels may also be used under appropriate conditions according to Bickes et al, for example, doping levels lower by a factor of 2 from the above-stated saturation levels are stated to be adequate and to provide corresponding resistivity values on the order of $10^{-3}$ to $10^{-4}$, for example, about $8\times10^{-4}$ ohm-centimeters.

Bickes et al discloses providing the semiconductor or other "electrical material" in the form of two relatively large surface area pads connected by a small surface area bridge, the pads being covered by metallized lands which leave the bridge exposed (see FIG. 1A and column 2, lines 40–52). Such devices are referred to as semiconductor bridge devices and the metallized lands provide electrical contacts for connecting a semiconductor bridge device in a circuit by soldering or the like. Bickes et al disclose (column 4, lines 35–46) that such metallized coatings will be composed of highly electrically conductive metals such as gold, silver, copper, aluminum, etc. The semiconductor bridge device of Example 1 of Bickes et al employs aluminum lands.

Such semiconductor bridge devices are stated to have the requisite characteristics for initiating an explosive maintained in contact with the semiconductor. As stated at column 2, lines 53–61 of Bickes et al, initiation of the explosive is believed to be caused by a combination of ignition and initiation effects, essentially a process of burning but also involving the formation of a thin plasma and a resultant convective shock effect.

SUMMARY OF THE INVENTION

Generally, the present invention provides a semiconductor bridge device having a stratified metal layer thereon which may be used in a variety of applications including, but not limited to, an explosive-initiating device, a localized high heat generator and a temperature sensing device.

Specifically, in accordance with the present invention there is provided a semiconductor bridge device which comprises the following components. An electrically non-conducting substrate, which may comprise, e.g., sapphire, silicon dioxide on silicon, or silicon nitride on silicon, has an electrically-conducting material, e.g., a semiconductor, which optionally may be a doped semiconductor, mounted thereon. The electrically-conducting material has a temperature coefficient of electrical resistivity which is negative at a given temperature above about 20° C. and below about 1400° C. The electrically-conducting material, which may be selected from, e.g., monocrystalline silicon, polycrystalline silicon and amorphous silicon, defines a bridge connecting a pair of spaced-apart pads. The bridge and the pads are so dimensioned and configured that passage therethrough of an electrical current of selected characteristics releases energy at the bridge. For example, in those embodiments in which the device comprises an explosive initiating device, the device is designed so that passage of the electrical current therethrough releases at least sufficient energy to initiate an explosive placed in contact with the bridge. A pair of spaced-apart metallized lands are disposed one on each of the spaced-apart pads so as to leave at least a portion of the bridge uncovered. Each of the metallized lands comprises (i) a base layer comprised of titanium and disposed upon its associated pad, (ii) an intermediate layer comprised of titanium and tungsten and disposed on its associated base layer, and (iii) a top layer comprised of tungsten and disposed on its associated intermediate layer. An electrical conductor is connected to each of the metallized lands for passing an electrical current of the selected characteristics through the bridge.

Another aspect of the invention provides for the electrically-conducting material, e.g., the semiconductor, of which bridge and pads are made, to be a hybrid material comprised of two materials; the electrically-conducting material being covered by a stratified metal layer, which preferably covers the entire top surface of the electrically-conducting layer, i.e., bridge and pads. The stratified metal layer comprises (i) a base layer comprised of titanium and disposed upon the electrically-conducting semiconductor material, (ii) an intermediate layer comprised of titanium and tungsten and disposed upon its associated base layer, and (iii) a top layer comprised of tungsten and disposed on its associated intermediate layer. A pair of spaced-apart metallized lands are disposed on the stratified metal layer, one above each of the spaced-apart pads so as to leave at least a portion of the stratified layer of the bridge uncovered. Each of the metallized lands comprises an electrically conductive metal layer that may be of the same material as the third (tungsten) layer on the stratified layer or of any other suitable electrically conductive material, for example, aluminum.

In one aspect of the invention the surface area of the spaced-apart pads is sufficiently greater than the surface area of the bridge whereby the electrical resistance across the pads is substantially determined by the bridge. The electrical resistance of the bridge may be less than ten, e.g., less than three, ohms.

Another aspect of the present invention provides the device to be an explosive-initiating device and for an explosive material to be disposed in contact with the initiation bridge.

In another aspect, the invention provides for the bridge and the pads to be so dimensioned and configured that passage therethrough of an electrical current of selected characteristics releases at the bridge sufficient energy to initiate an explosive placed in contact with the bridge.

Another aspect of the invention further provides for the surface area of the spaced-apart pads to be sufficiently greater than the surface area of the bridge whereby the electrical resistance across the pads is substantially that of the bridge.

Yet another aspect of the present invention provides for a housing enclosing the substrate, the semiconductor material and the metallized lands and comprising a receptacle within which the explosive is received.

Yet another aspect of the present invention provides for a hybrid device comprising the following components. An electrically non-conducting substrate has an electrically-conducting material mounted thereon. The electrically-conducting material has a temperature coefficient of electrical resistivity which is negative at a given temperature above about 20° C. and below about 1400° C., the material defining a bridge connecting a pair of spaced-apart pads, the bridge and the pads being so dimensioned and configured that passage therethrough of an electrical current of selected characteristics releases energy at the bridge. A stratified metal layer is disposed over the electrically-conducting material, preferably over the entire surface thereof, and comprises (i) a base layer comprised of titanium and disposed upon the electrically-conducting material, (ii) an intermediate layer comprised of titanium and tungsten and disposed on the base layer, and (iii) a top layer comprised of tungsten and disposed on the intermediate layer. A pair of spaced-apart metallized lands are disposed one on each of the spaced-apart pads, and leave at least a portion of the bridge uncovered. An electrical conductor is connected to each of the metallized lands for passing an electrical current of the selected characteristics through the bridge.

A method aspect of the present invention provides for making a semiconductor bridge device by the following steps. First, depositing on an electrically non-conducting substrate, e.g., sapphire, silicon dioxide on silicon, or silicon nitride on silicon, an electrically-conducting material, e.g., a semiconductor, preferably a doped semiconductor. The electrically-conducting material has a temperature coefficient of electrical resistivity which is negative at a given temperature above about 20° C. and below about 1400° C. and defines a bridge connecting a pair of spaced-apart pads. The bridge and the pads are so dimensioned and configured that passage therethrough of an electrical current of selected characteristics releases energy at the bridge. The method next calls for depositing, e.g., by metal sputtering, a stratified metal layer over at least each of the spaced-apart pads by (i) first depositing a base layer comprised of titanium upon the electrically conducting material, (ii) then depositing an intermediate layer comprised of titanium and tungsten upon the base layer, and (iii) lastly depositing a top layer comprised of tungsten upon the intermediate layer and forming a metallized land over each of the spaced-apart pads. An electrical conductor is then connected to each of the metallized lands for passing an electrical current of the selected characteristics through the bridge.

One related aspect of the method of the invention provides for depositing the stratified metal layer over only each of the spaced-apart pads to form a pair of spaced-apart metal lands while leaving at least a portion of the bridge uncovered.

Another related aspect of the method of the invention provides for depositing the stratified layer over the electrically-conducting material including both the bridge and the pads, and in doing so depositing the tungsten top layer in a thickness greater than that required for a desired resistivity of the bridge. Thereafter, the thickness of the top layer over the bridge only is reduced (but the top layer over the bridge is not entirely removed) to provide a desired bridge resistivity and a pair of spaced-apart tungsten lands.

Still another method aspect of the present invention further comprises placing an explosive in contact with the bridge; other method aspects provide depositing the metals in the thickness proportions and compositions as described below.

Other aspects of the invention are disclosed in the following description and in the drawings.

DETAILED DESCRIPTION OF THE INVENTION AND PREFERRED EMBODIMENTS THEREOF

Figure 1:
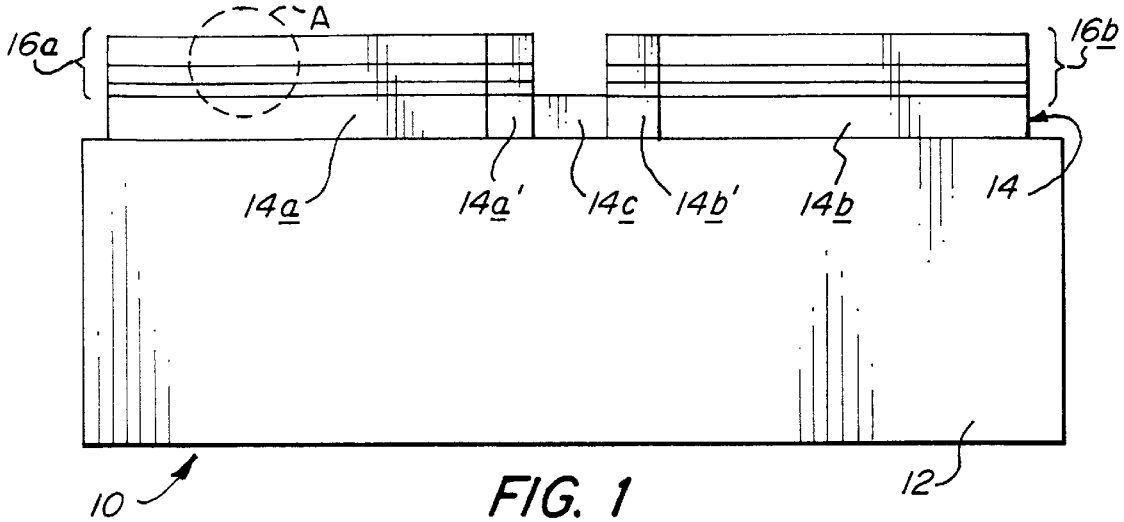
FIG. 1 is a schematic elevation view of a semiconductor bridge in accordance with one embodiment of the present invention.
Figure 2:
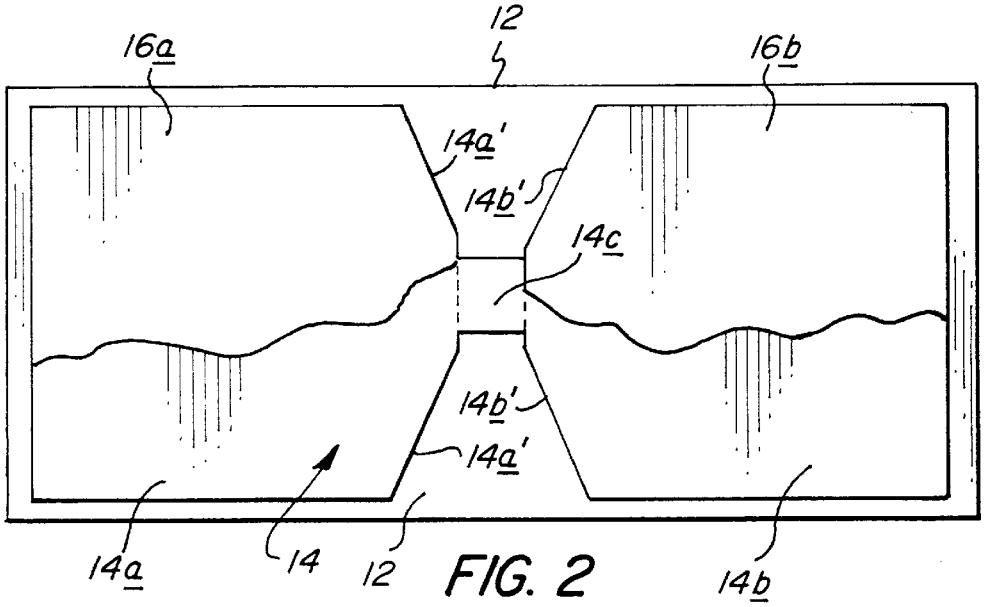
FIG. 2 is a plan view of the semiconductor bridge of FIG. 1.
Figure 1A:
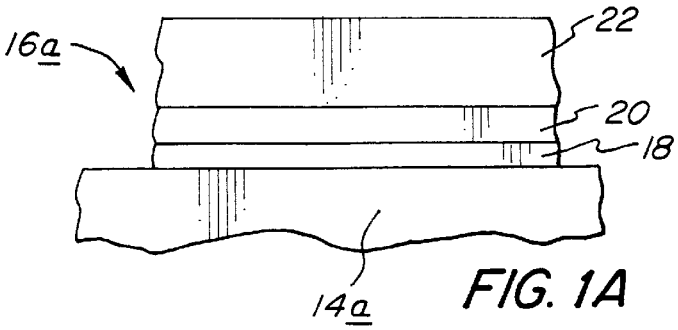
FIG. 1A is a view, enlarged with respect to FIG. 1, of approximately the area of FIG. 1 enclosed by the circle A.

Referring now to FIGS. 1, 1A and 2, there is shown a semiconductor bridge device 10 comprising an electrically non-conducting substrate 12 which may comprise any suitable electrically non-conducting material. Generally, as is well-known in the art, a non-conductive substrate can be a single or multiple component material. For example, a suitable non-conducting substrate for polycrystalline silicon semiconductor material comprises an insulating layer (e.g., silicon dioxide, silicon nitride, etc.) disposed on top of a monocrystalline silicon substrate. This provides a well-known suitable combination of materials for substrate 12. A suitable non-conducting substrate for monocrystalline silicon semiconductor materials comprises sapphire, also a known suitable material for substrate 12. An electrically-conducting material comprising, in the illustrated embodiment, a heavily doped silicon semiconductor 14 is mounted on substrate 12 by any suitable means known in the art, for example, by epitaxial growth or low pressure chemical vapor deposition techniques. As best seen in FIG. 2, semiconductor 14 comprises a pair of pads 14*a*, 14*b* which in plan view are substantially rectangular in configuration except for the facing sides 14*a'*, 14*b'* thereof which are tapered towards initiator bridge 14*c*. Bridge 14*c* connects pads 14*a* and 14*b* and is seen to be of much smaller surface area and size than either of pads 14*a*, 14*b*. It is seen from FIG. 2 that the resultant configuration of the semiconductor 14 somewhat resembles a "bow tie" configuration, with the large substantially rectangular pads 14*a*, 14*b* spaced apart from and connected to each other by the small initiator bridge 14. A pair of metallized lands 16*a* and 16*b*, partly broken away in FIG. 2 in order to partially show pads 14*a*, 14*b*, overlie pads 14*a*, 14*b* and, in the illustrated embodiment, entirely cover the upper surface of the same.

Metallized lands 16*a* and 16*b* are substantially identical and the detailed illustration of FIG. 1A of a portion of metallized land 16*a* is typical also of metallized land 16*b*. Metallized lands 16*a* and 16*b* are of a planar, plate-like configuration as illustrated, e.g., in FIGS. 1 and 1A.

As indicated above, the prior art generally teaches the use of any highly electrically conductive metal for the lands 16*a* and 16*b*. Aluminum is generally preferred in the prior art, as illustrated by the aforementioned Bickes et al patent which exemplifies aluminum for the metallized lands, because of its low electrical resistivity, i.e., high electrical conductivity, relatively low cost as compared to other metals and ease of fabrication. Conventionally, aluminum lands are deposited by metal evaporation or sputtering techniques and must be annealed in order to lower their contact resistance and to ensure both proper adhesion to the semiconductor pads and bondability to wires or other electrical leads which, as described below, are connected to the lands to energize the semiconductor bridge device. However, the relatively low melting point of aluminum (660° C.) and its chemical interaction with semiconductor materials (silicon in particular) at about 400° C. limits the range of applications of a semiconductor bridge device having aluminum lands because of interdiffusion effects between aluminum and the semiconductor material, and because of electromigration of aluminum from the metallized lands over the bridge area at elevated temperatures, as illustrated in FIG. 6, which is described below.

Figure 6:
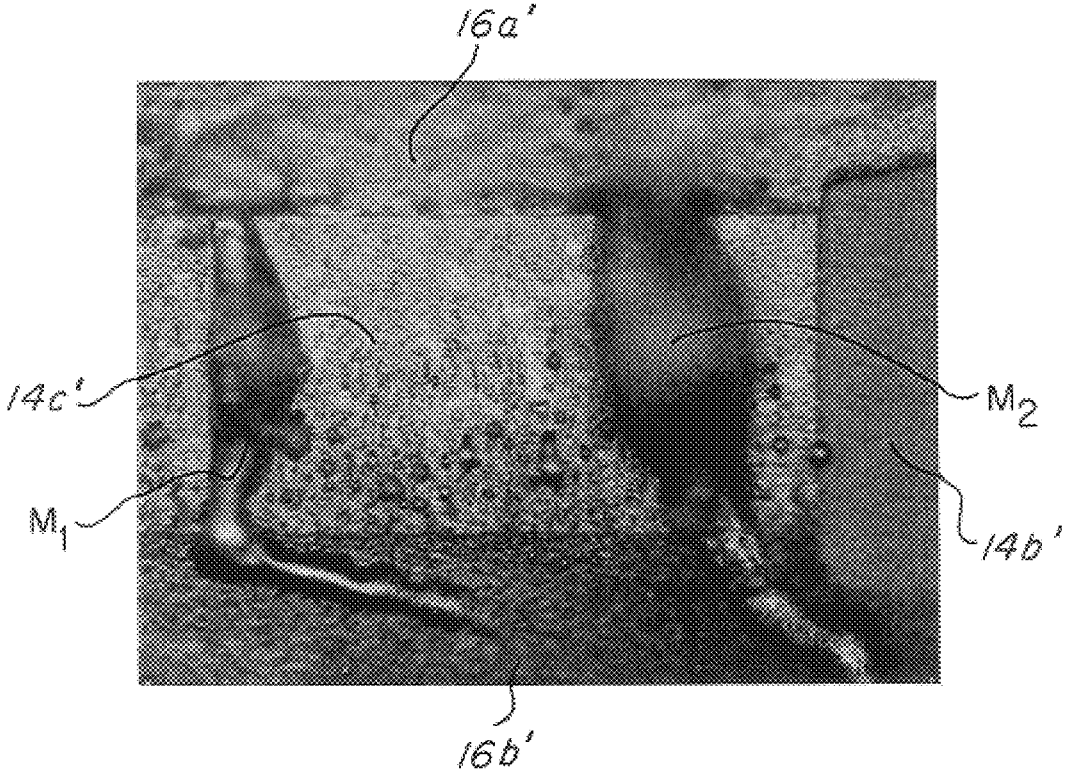
FIG. 6 (PRIOR ART)
FIG. 6 is a microphotograph showing the electromigration of aluminum from the aluminum lands of a prior art device.

The electromigration phenomenon illustrated in FIG. 6 renders the semiconductor bridge device inefficient and in some cases ineffective, especially for semiconductor bridge devices incorporating small bridges where low initiation voltage or current pulses are needed.

In some cases it is known to employ tungsten in place of aluminum for the metallized lands and in either case a closely-controlled deposition procedure, usually by metal evaporation or sputtering techniques, is necessary because oxide layers which grow on unprotected semiconductor surfaces, such as the unprotected surfaces of silicon semiconductor materials, adversely affect the quality of the metal-to-semiconductor interface by causing high contact resistance and poor adhesion of the metal to the semiconductor. In most cases, the deposition of aluminum or tungsten on silicon must be followed by thermal annealing at or above 450° C., which has the undesirable side effect, in the case of aluminum, of causing a chemical reaction between the aluminum and the silicon. Although such chemical reaction results in a lower contact resistance, it results in a higher resistance of the initiation bridge. In the case of tungsten, such annealing tends to cause oxidation of the tungsten at relatively low temperatures which of course is problematic as it reduces the electrical conductivity of the metallized lands.

The present invention overcomes the foregoing shortcomings of the prior art by employing titantium and tungsten in a specific combination to provide a metallized land comprised of layers of different metals. Specifically, the present invention provides a multilayered metallized land in which a base layer disposed upon the semiconductor material is comprised of titanium, an intermediate layer is comprised of a combination of titanium and tungsten and is disposed upon the base layer, and a top layer is comprised of tungsten and is disposed upon the intermediate layer. Thus, with reference to FIG. 1A, the metallized land 16*a* is seen to comprise a base layer 18 made of titanium, an intermediate layer 20 made of a combination of titanium and tungsten, and a top layer 22 made of tungsten. The respective layers may contain trace amounts of other metals or even alloying amounts of other metals. However, in a specific embodiment, the base layer 18 may consist essentially of titantium, the intermediate layer 20 may consist essentially of titanium and tungsten and the top layer 22 may consist essentially of tungsten.

It has been found that the multilayered metallized lands of the present invention overcome the electromigration problem associated with the use of aluminum lands and the oxidation and deposition problems associated with the use of tungsten lands. The multilayered lands of the present invention need not be annealed and nonetheless exhibit excellent properties of adhesion to the semiconductor 14, such as a highly doped silicon semiconductor material.

In the manufacture of a semiconductor bridge device as illustrated in FIGS. 1–2, the semiconductor 14 is grown or deposited upon the electrically non-conducting substrate 12 in a manner well-known in the art to provide a configuration of the semiconductor 14 substantially as illustrated in FIG. 2. (It will be appreciated by those skilled in the art that the Figures are not drawn to scale, for example, the thickness of the individual metal lands is greatly exaggerated for clarity of illustration.) Known thermal diffusion techniques may be utilized, for example, to dope with phosphorus the silicon semiconductor 14, which is then selectively etched in the pattern illustrated in FIG. 2 onto a suitable non-electrically-conducting substrate 12 such as a silicon dioxide on silicon or silicon nitride on silicon substrate, or a sapphire substrate. The resultant semiconductor 14 is then acid-cleaned and the area of the bridge 14*c* as seen in FIG. 2 is coated with a lift-off photoresist layer. A second acid dipping is then carried out to remove the native oxide from the exposed surface of the semiconductor layer and titanium is applied as base layer 18, a mixture of titanium and tungsten is applied as intermediate layer 20 and tungsten is applied as top layer 22. Although any suitable metal deposition technique may be employed, inasmuch as tungsten is very difficult to deposit by thermal evaporation because of its very high melting point, metal sputtering is preferred for the tungsten deposition. In order to simplify the process, it is preferred to use the same metal sputtering technique for the titanium, which, however, could also readily be deposited by metal evaporation techniques.

EXAMPLE 1

Substrates 12 have deposited thereon in the pattern illustrated in FIG. 2 a heavily doped polycrystalline silicon semiconductor 14 which has a positive temperature coefficient of resistivity of about 0.2% ohm centimeter per degree centigrade at a temperature near 25° C. and exhibits a negative temperature coefficient of resistivity at a temperature of 600° C. or higher. The temperature at which the negative temperature coefficient of resistivity is exhibited depends on the doping concentration of the silicon semiconductor 14 and can be designed to be within the range of 400° C. to 1400° C., just below the melting point (1412° C.) of silicon. The resultant wafers are thoroughly acid-cleaned with hydrogen peroxide plus sulfuric acid and are then coated with a photoresist mask to cover their respective bridge areas 14*c*. The photoresist masks are then exposed and developed to protect the initiator bridges 14*c* against metal deposition. The photoresist-coated wafers are then dipped in a buffered hydrofluoric acid solution to remove the native oxide from the exposed silicon semiconductor surfaces of pads 14*a* and 14*b*. This hydrofluoric acid dipping procedure is employed immediately before the wafers are loaded into a vacuum chamber wherein a base pressure of $1.3\times10^{-9}$ atmospheres or lower is maintained prior to deposition. The wafers are positioned immediately above the sputtering target source and continuously rotated during the metal deposition process. The vacuum chamber is then backfilled with an inert gas to a deposition pressure of about $6.5\times10^{-7}$ atmospheres. The titanium target is first sputtered with a deposition rate of about 0.7 Angstroms per second until a thickness of approximately 300 Angstroms of titanium is attained for base layer 18. Co-sputtering of titanium and tungsten targets is then commenced by letting the titanium sputtering continue while initiating the tungsten sputtering to attain a combined deposition rate of about 2.4 Angstroms per second until a mixed titanium-tungsten intermediate layer 20 of about 100 Angstroms thickness is obtained. At this point sputtering of the titanium target is stopped and that for the tungsten target continues at a deposition rate of about 1.7 Angstroms per second until a desired thickness of tungsten of top layer 22 is attained, which will typically be a thickness of between about 1 to 1.5 micrometers (microns). The wafers are then allowed to cool to ambient temperature from the deposition temperature and the photoresist mask is then lifted from the initiator bridge 14*c*. The wafers are then rinsed with acetone in an ultrasonic bath followed by an alcohol dip, and finally rinsed with de-ionized water, and tested for electrical resistance.

Preferably, the electrical resistance of the bridge is less than ten ohms, more preferably less than three ohms, and the metallized lands 16*a*, 16*b* may completely cover their associated spaced-apart pads 14*a*, 14*b*.

The semiconductor material may be selected from the group consisting of different types of silicon crystals (e.g., monocrystalline, polycrystalline or amorphous silicon) and may be doped with impurities such as phosphorus, arsenic, boron, aluminum, etc.

Generally, in the metallized lands the thickness of the titanium base layer 18 may be from about 50 to 350 Angstroms, preferably 250 to 300 Angstroms, the thickness of the titanium-tungsten intermediate layer 20 may be from about 50 to 200 Angstroms, preferably from about 100 to 150 Angstroms, and the thickness of the tungsten top layer 22 may be from about 0.7 to 1.5 microns, preferably 1.0 to 1.2 microns.

The proportions of titanium and tungsten in intermediate layer 20 may be from about 20 to 80 weight percent titanium and from about 80 to 20 weight percent tungsten, preferably from about 40 to 60 weight percent titanium and from about 60 to 40 weight percent tungsten.

In depositing the titanium-tungsten intermediate layer 20, the deposition of tungsten (and that of the titanium) may be maintained at a uniform rate throughout deposition of intermediate layer 20. Such constant rate deposition technique will provide a substantially constant titanium to tungsten ratio throughout substantially the entire thickness of intermediate layer 20. Alternatively, the deposition of tungsten to start the intermediate layer 18 may start slowly and increase in rate and the termination of the titanium deposition may be attained by gradually reducing the rate of deposition of titanium to zero. In this way, as an alternative to a constant proportion of titanium to tungsten in intermediate layer 18, concentration gradients of titanium and tungsten are attained in intermediate layer 20, the concentration of titanium decreasing, e.g., from 100% to zero, and that of tungsten increasing, e.g., from zero to 100%, as sensed moving through intermediate layer 20 from base layer 18 to top layer 22. As another alternative in depositing intermediate layer 20 to attain concentration gradients therein, the deposition rate of tungsten may be held constant and the deposition rate of titanium gradually reduced. In cases where such concentration gradients are employed, the claimed proportions of titanium to tungsten in intermediate layer 20 are based on the total titanium and tungsten contents of the entire intermediate layer.

The technique of the present invention does not require expensive equipment or the use of toxic and expensive chemicals as is required, for example, with chemical vapor deposition of tungsten. Further, the present invention avoids the necessity of depositing tungsten directly upon the semiconductor layer. Tungsten is highly sensitive to the cleanliness of typical silicon semiconductor surfaces and the presence of impurities often results in high contact resistance and poor adhesion of a tungsten surface directly to the silicon. The preferred sputtering technique of the present invention employs two sputtering targets, one titanium and one tungsten, and does not generate toxic by-products. The base layer 18 of titanium overcomes the problems associated with directly depositing tungsten upon the semiconductor layer and the intermediate titanium-tungsten layer 20 provides good adhesion of the titanium and tungsten layers.

The multilayered metallized lands of the present invention provide a semiconductor bridge device whose no-fire capability has been dramatically improved because no low melting point metals are present in the device. The melting point of titanium, 1,660° C., is higher than that of silicon (1,412° C.) which means that migration of titanium across the bridge to short circuit the device will not take place even at temperatures higher than those which the semiconductor layer itself can sustain. Titanium reacts with silicon at about 600° C. and requires at least about 30 minutes to fully form titanium silicide ($TiSi_2$), which has a melting point of about 1,540° C. and is stable on silicon up to a temperature of about 900° C. This means that even if all the titanium has reacted with silicon during a very long high temperature no-fire test, neither the titanium nor the titanium silicide will present electromigration problems that might cause failure of the device.

On the other hand, tungsten has a very high melting point of 3,410° C. and does not react with titanium although it does react with silicon at about 600° C. Even though tungsten does not present electromigration problems, placing tungsten in direct contact with silicon results in a temperature-sensitive situation during no-fire tests because a sudden change in the bridge resistance has been observed when such tungsten semiconductor bridge devices are at a temperature of about 600° C. However, the provision of a titanium layer between the tungsten and the silicon in accordance with the present invention eliminates this temperature sensitivity because the titanium acts as a barrier layer between the tungsten and the silicon semiconductor material.

By way of comparison, a typical small semiconductor bridge device using the prior art aluminum metallized lands cannot survive longer than about 3 to 5 seconds when tested in air with a constant current source of about 0.7 amperes. However, the same device fabricated with the multilayered titanium/titanium-tungsten/tungsten metallized lands in accordance with the present invention and having the same initial resistance and tested under exactly the same conditions is capable of surviving for more than 400 seconds when tested in air with a constant current source of 0.7 amperes, without experiencing any physical damage.

Semiconductor Bridges as Localized Heat Generators

As a result of the increased thermal stability that the titanium/titanium-tungsten/tungsten multilayered structure provides to semiconductor bridge devices (sometimes below referred to as "SCBs" or, in the singular, "SCB"), it is possible to generate and sustain relatively high temperatures (400° C. to 800° C.) in relatively small bridge areas (e.g., 15×36 pm) for extended periods of time (1 to 20 minutes) without destroying the device and/or significantly changing its electrical properties.

Figure 7A:
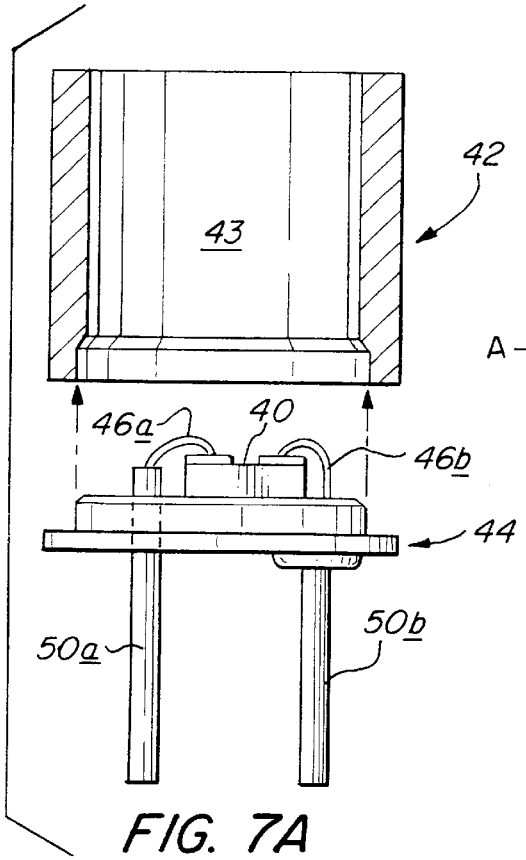
FIG. 7A is an exploded section view taken along line A—A of FIG. 7.
Figure 7:
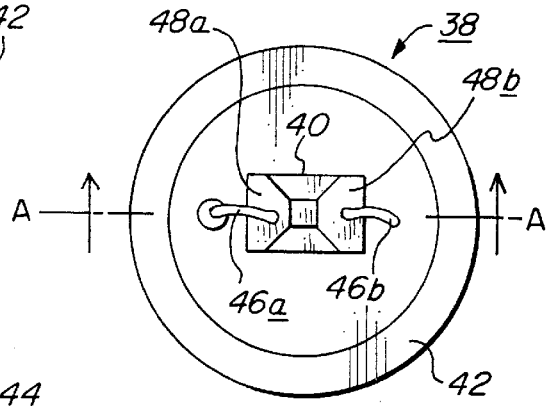
FIG. 7 is a top plan view of a semiconductor bridge device in accordance with one embodiment of the present invention.

For example, an SCB may be assembled with a TO46 header and a brass charge holder, as shown in FIGS. 7 and 7A. FIG. 7 shows an explosive initiating device 38 comprising a brass charge holder 42 surmounting a TO46 header 44. Brass charge holder 42 is substantially cylindrical in shape and when mounted upon header 44 defines a cavity 43 within which a suitable explosive charge may be mounted in contact with semiconductor bridge device 40. Semiconductor bridge device 40 has the multi-layered titanium/titanium-tungsten/tungsten lands in accordance with an embodiment of the present invention. Electrically conductive wires 46*a*, 46*b* connect lands 48*a*, 48*b* to header 44. Header 44*a* has a pair of connectors 50*a*, 50*b* to the tops of which wires 46*a*, 46*b* are connected at one end.

The other end of wires 46*a*, 46*b* are connected to, respectively, lands 48*a*, 48*b*. Connectors 50*a*, 50*b* may thus be connected to a source of electrical current in order to fire semiconductor bridge device 40.

The device of FIGS. 7 and 7A, whose bridge dimensions are 15×36 pm, can glow red-hot in air at a temperature of at least about 600° C. for at least 2 or 3 minutes under, for example, the influence of a 700 milliamperes constant current. The SCB, under the influence of a constant current pulse, generates heat constantly until a thermal equilibrium situation (heat losses equal the heat generated) is reached or until the device reaches its thermal runaway point at which the device suffers irreversible damage and possible firing. However, if a train of short current pulses with an adequate amplitude and frequency is used instead to heat the SCB, then sustaining a given constant temperature within the specified range is possible.

With the prior art SCBs having aluminum lands, thermal interaction between aluminum and silicon occurs at temperatures as low as about 350° C. This increases the device's electrical resistance, the heating rate being given by $I^2R$, and increases its susceptibility to aluminum electromigration at about 600° C., thus rendering the SCB inoperable and inefficient. Application of such localized high heat generators can be in the form of micro-heaters, where high temperatures in relatively small areas (for example, from 100 $\mu m^2$ to 1000 $\mu m^2$) are needed as sources of heat energy. Conversely, the SCBs of the present invention can be used to accurately determine high temperatures by monitoring current flow through them.

The Hybrid SCB

Because of the excellent thermal stability that the multi-layered or stratified titanium/titanium-tungsten/tungsten structure offers, the stratified metal structures of the present invention will improve SCB devices that employ a tungsten-covered electrically-conducting layer (bridge and pads) in accordance with the teachings of U.S. Pat. No. 4,976,200, issued on Dec. 11, 1990, to D. A. Benson et al. Benson et al shows an all-tungsten cap or cover over the semiconductor, to provide a hybrid semiconductor layer. Not only can the multi-layered titanium/titanium-tungsten/tungsten metal structure of the present invention be used to provide the metal lands, but also to cap or cover the, e.g., silicon bridge and pads, to provide a hybrid bridge. The thickness and resistivity of both the titanium/titanium-tungsten/tungsten and silicon layers are of critical importance in determining the performance of the resulting hybrid bridge SCB.

Figure 8:
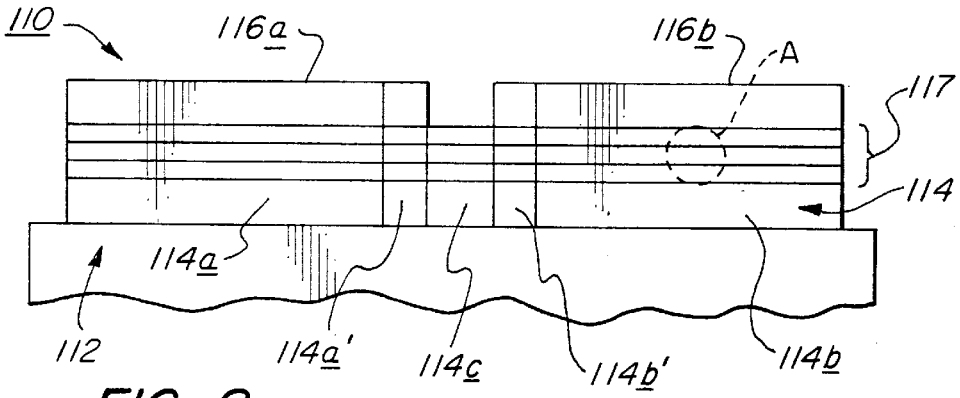
FIG. 8 is a partial section view of a semiconductor bridge device in accordance with another embodiment of the present invention in which the electrically-conducting layer is capped or covered by a stratified metal layer.

Referring now to FIG. 8, there is shown a view generally corresponding to FIG. 1 in which the components thereof which are identical or similar to those of FIG. 1 are identically numbered thereto, except that each number is 100 greater than the corresponding number of FIG. 1. Thus, FIG. 8 shows a hybrid semiconductor bridge device 110 comprising an electrically non-conducting substrate 112 which is partially broken away in FIG. 8, surmounted by a semiconductor 114 comprised of a pair of pads 114*a*, 114*b* having respective facing sides 114*a'*, 114*b'*, and which are connected by a bridge 114*c*. The entire semiconductor 114, including the pad and bridge portions thereof, are covered by a cap or cover layer 117. A pair of metallized lands 116*a*, 116*b* made of tungsten or other suitable metal, e.g., aluminum, are disposed upon cover layer 117 and superposed above pads 114*a*, 114*b* thereof.

Figure 9A:
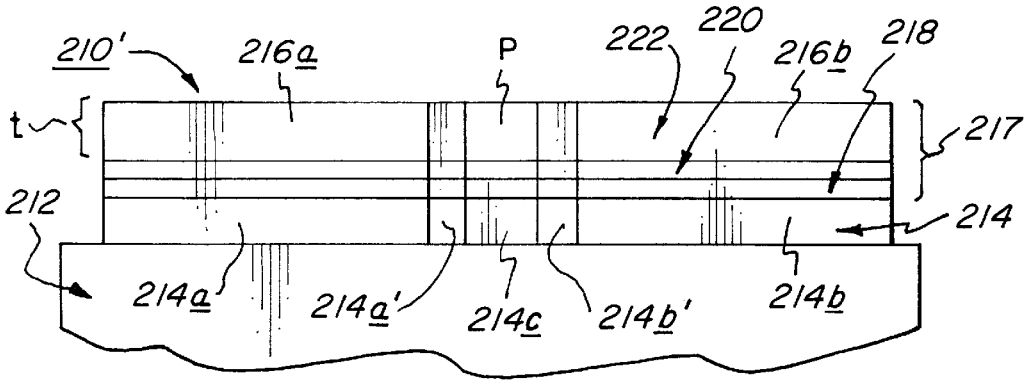
FIG. 9A is a view corresponding to FIG. 8 of a stage in the manufacture of a second embodiment of the present invention, in which the electrically-conducting layer is capped or covered by a stratified metal layer.

One manufacturing technique for making a hybrid SCB device of the invention with tungsten lands is to deposit, e.g., by metal sputtering, the three stratified layers with the base layer (titanium) and the intermediate layer (titanium/tungsten) deposited in the same thickness over both the bridge and pad areas. The topmost tungsten layer is then deposited in a layer made thick enough, e.g., 1.5 microns in thickness, to serve as the land areas. This is illustrated in FIG. 9A, wherein parts which are similar or identical to those of FIG. 1 are identically numbered thereto, except that each number is 200 greater than the corresponding number of FIG. 1. As these parts were described in detail with respect to FIGS. 1 and 8, their description is not repeated herein except as necessary for a full understanding. Thus, FIG. 9A shows device 210' at a stage in the manufacture of the semiconductor bridge device 210 of FIG. 9B wherein a semiconductor 214 is disposed upon an electrically non-conducting substrate 212 and has formed thereon a cap or cover 217 comprised of a titanium base layer 218, a titanium and tungsten intermediate layer 220 and a tungsten top layer 222. Layers 218 and 220 are formed to their ultimately desired thickness but top layer 222 is made to a thickness t suitable for the metallized lands 216*a* and 216*b*.

Figure 9B:
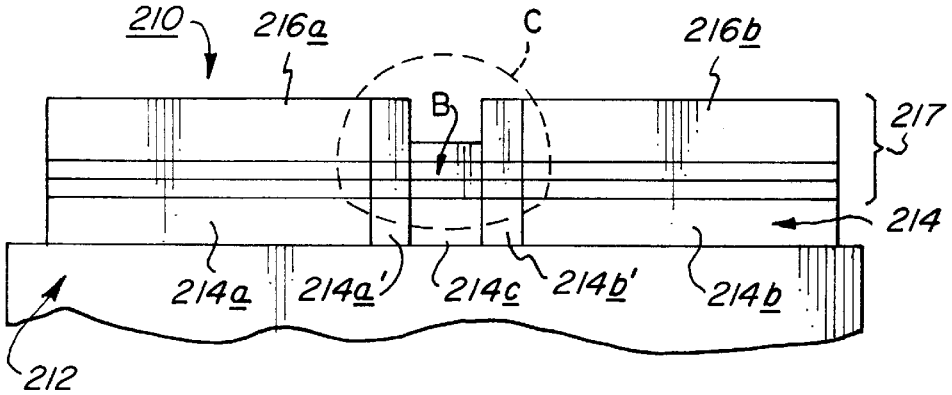
FIG. 9B shows a later stage in the manufacture of the second embodiment shown in FIG. 9A.
Figure 9C:
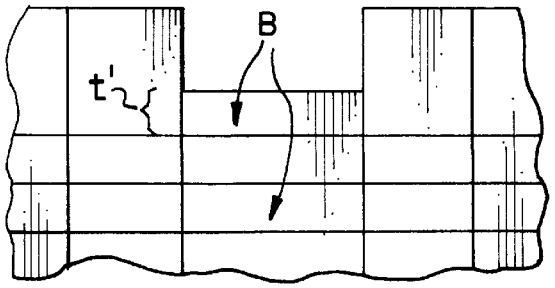
FIG. 9C is a view, enlarged with respect to FIG. 9B, of approximately the area of FIG. 9B enclosed by the area C.

Consequently, the portion P of top layer 222 in the bridge area between lands 216*a* and 216*b* is too thick to provide the proper resistivity for the bridge B (FIG. 9B). Accordingly, the portion P of top layer 222 is etched or otherwise treated to reduce it to a thickness t' (FIG. 9C) which will give the desired resistivity for the bridge B and form lands 216*a*, 216*b* (FIG. 9B). Typically, the thickness t' of the top layer of tungsten in the area of the bridge B will be from about 500 to 1,500 Angstroms.

Alternatively, the three metal layers may be deposited over the bridge and pad areas in the respective thicknesses required to impart the desired resistivity to the bridge. The metallized lands are then deposited, e.g., by metal sputtering or chemical vapor deposition, onto the portions of the stratified layer over the pad areas only. The lands, as noted above, may then be made of any suitable, depositable material, e.g., tungsten, aluminum, etc.

Figure 8A:
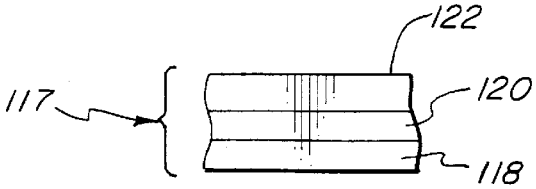
FIG. 8A is a view, enlarged with respect to FIG. 8, of approximately the area of FIG. 8 enclosed by the circle A.

The structures of the devices of FIGS. 8 and 9B are thus similar to that of the FIG. 1 embodiment except for the interposition of the respective caps or cover layers 117, 217. In accordance with the present invention, layers 117, 217 are, instead of the all-tungsten layer of U.S. Pat. No. 4,976,200, a stratified or multi-layer which is identical or similar in configuration (but not necessarily the thickness of each layer) to metallized land 16*a* as best seen in FIG. 1A. Thus, as illustrated in FIG. 8A, layer 117 may comprise a base layer 118 of titanium, an intermediate layer 120 of titanium-tungsten and a top layer 122 of tungsten. The thickness of layer 117 (or 217) may differ from the thickness of metallized land 16*a*; similarly, the thickness of the individual layers 118, 120 and 122 may also differ from the thickness of the individual layers 18, 20 and 22.

The improved performance of such titanium/titanium-tungsten/tungsten SCB is based on the excellent adhesion properties that the base titanium layer presents to silicon semiconductors, the preferred bridge material, and that the intermediate titanium-tungsten layer presents to tungsten. This excellent adhesion property improves the flow of heat from the titanium/titanium-tungsten/tungsten layer into the underlying, e.g., silicon, layer of the bridge.

With the prior art (U.S. Pat. No. 4,976,200), use of expensive equipment like chemical vapor deposition reactors is needed to fabricate the tungsten-covered bridge SCBs. However, this does not compensate for the thermal interaction between tungsten and silicon at medium temperatures (600° C. to 800° C.). These temperatures increase the interfacial tungsten-silicon contact resistance which in turn limits the amount of electrical energy (or heat) that can be transferred to the silicon semiconductor material underneath the tungsten bridge. This makes the improved hybrid bridge of the present invention, using the multilayered titanium/titanium-tungsten/tungsten material more efficient that the prior art tungsten-only bridge cover as described in U.S. Pat. No. 4,976,200.

Explosive-Initiating Devices

Figure 3A:
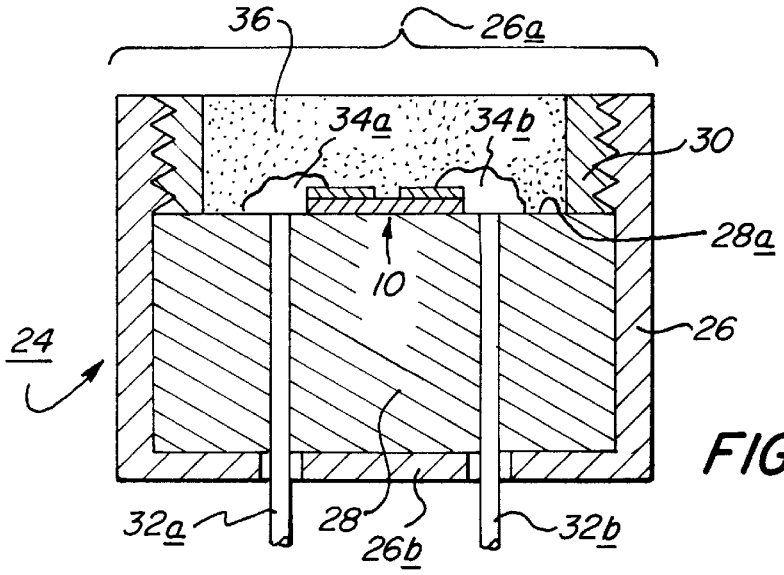
FIG. 3A is a cross-sectional elevation view taken along line A—A of FIG. 3.
Figure 3:
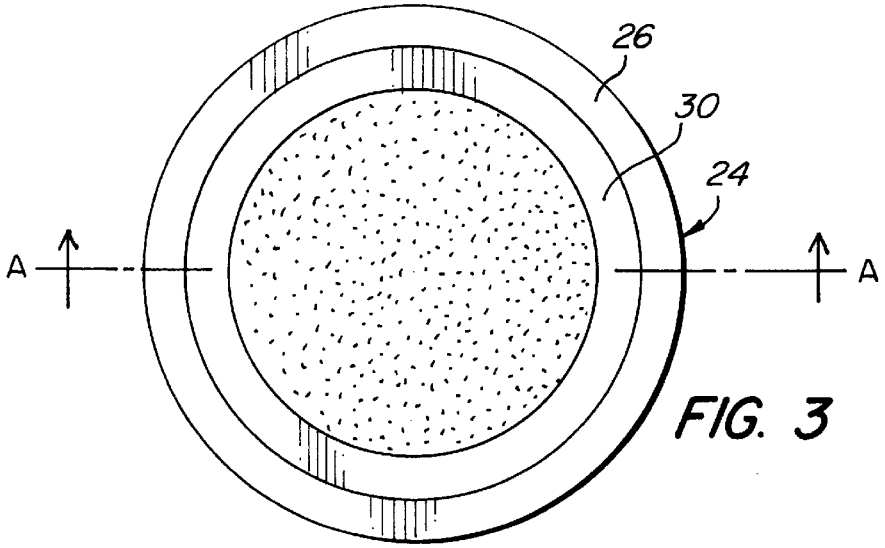
FIG. 3 is a plan view of a typical explosive initiation device in accordance with one embodiment of the present invention which includes the semiconductor bridge of FIGS. 1–2.

Referring now to FIGS. 3 and 3A there is shown an example of an explosive initiation device 24 in accordance with one embodiment of the present invention comprising a generally cylindrical housing 26 having an open end 26*a* and a closed end 26*b*. The interior of housing 26 is threaded at the open end 26*a* thereof. A ceramic or metal base 28 is retained in place within housing 26 by a retainer ring 30 which has exterior threads (unnumbered) formed thereon and which is threadably received at the open end 26*a* of housing 26.

A semiconductor bridge device 10, such as illustrated in FIGS. 1–2, is mounted upon a ceramic or metal base 28. A pair of electrical leads 32*a*, 32*b* extend through apertures (unnumbered) provided at the closed end 26*b* of housing 26 and through bores (unnumbered) provided in ceramic or metal base 28. Electrical leads 32*a*, 32*b* are exposed at the upper (as viewed in FIGS. 3A and 3B) surface 28*a* (FIG. 3B) of ceramic or metal base 28, where they are connected in electrical conductivity relationship with metallized lands 16*a*, 16*b* by solder or wire bonding connections 34*a*, 34*b*.

Figure 3B:
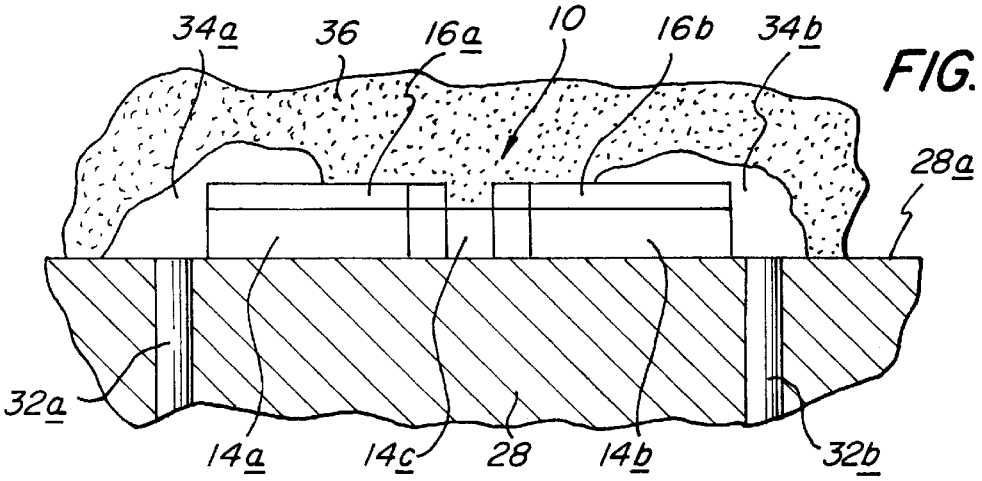
FIG. 3B is a view, enlarged with respect to FIG. 3A, of the semiconductor bridge of the explosive initiation device of FIG. 3, and the immediately surrounding components thereof.

A suitable explosive 36 is pressed into the cup-like receptacle formed within retainer ring 30 at open end 26*a* of housing 26. Explosive 36 may be any suitable explosive, including relatively insensitive highly brisant explosives, because even such insensitive explosives may be reliably initiated by the semiconductor bridge device of the present invention. In any case, explosive 36 is usually provided as a compacted mass attained by pressing an explosive powder in place within retainer ring 30 to insure intimate contact under high pressure of explosive 36 with initiator bridge 14*c*, as best seen in FIG. 3B. For semiconductor bridge devices which operate at high voltages, e.g., greater than 400 volts, intimate contact between the explosive and the initiator bridge may not be necessary.

EXAMPLE 2

In order to compare a semiconductor bridge device of the present invention having as the metallized lands the layered metal structure disclosed herein with an otherwise identical prior art semiconductor bridge device in which the metallized lands are made of aluminum, the following devices were prepared.

Preparation of the two types of devices was carried out by doping two identical samples of silicon semiconductor material with phosphorus impurities to a uniform high concentration level of about $1\times10^{20}$ atoms/cm$^3$. One of the samples was used to make a Type B device (prior art), which was then metallized with aluminum. Next, both layers (aluminum and silicon) of the Type B device were etched and washed in order to define the length and width of the semiconductor bridge by using two different reticles and photoresist masks. Finally, sintering of the aluminum-silicon interface was carried out at 450° C. for 30 minutes.

The second sample was used to make a Type A device in accordance with an embodiment of the present invention. This sample was selectively masked with photoresist and the exposed silicon film was etched and washed to define the width of the bridge. The lift-off photoresist technique was then used to create a selective mask for the deposition of the multilayered metal structure (Ti/Ti—W/W) and to define the length of the bridge. Sputtering deposition of Ti and W was next carried out according to the description given above for the present invention, in order to deposit about a 1.5 $\mu$m thick layer of titanium/titanium-tungsten/tungsten. The thicknesses of the respective layers were 0.03 $\mu$m titanium, 0.01 $\mu$m titanium-tungsten and 1.46 $\mu$m tungsten. After the sputtering deposition the photoresist mask was lifted off with solvents resulting in a selectively metallized sample. The remaining metal on the wafer covered the contact pads for the semiconductor bridge and defined the length of the bridge. The semiconductor bridge itself was metal-free.

Both the Type A and Type B devices were tested for electrical resistance and visually inspected for bridge size comparisons. Average electrical resistance for both types of devices was of 1.00±0.05 ohms for a sample size of approximately 1000 devices of each type. Average bridge size for both types of devices was of 14±2 $\mu$m for length and width, respectively, for same sample size of approximately 1000 devices of each type. To ensure a fair comparison between Type A and Type B devices, however, almost identical bridge size and resistance were selected for testing. Assembly of Type A and Type B devices into igniter units was done with standard TO46 headers and brass charge holders, as shown in FIG. 7.

Type A units in accordance with an embodiment of the present invention, and comparative, prior art Type B units were tested by being subjected to no-fire and all-fire tests.

No-Fire Test

Figure 4:
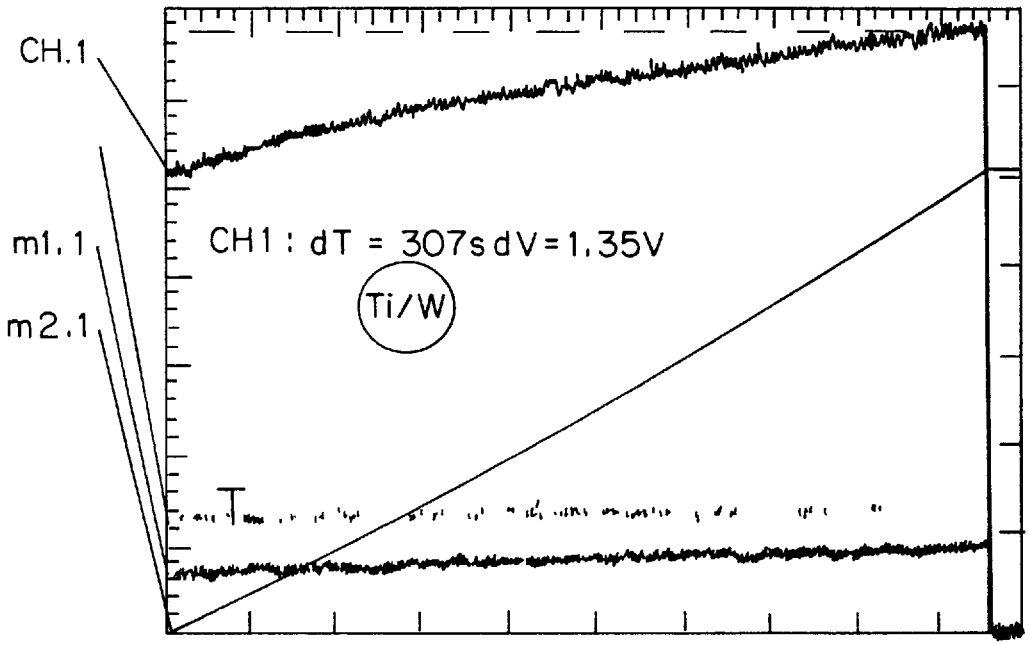
FIG. 4 is a plot showing the no-fire electrical characteristics of a semiconductor bridge device utilizing titanium/titanium-tungsten/tungsten metallized lands in accordance with an embodiment of the present invention.
Figure 5:
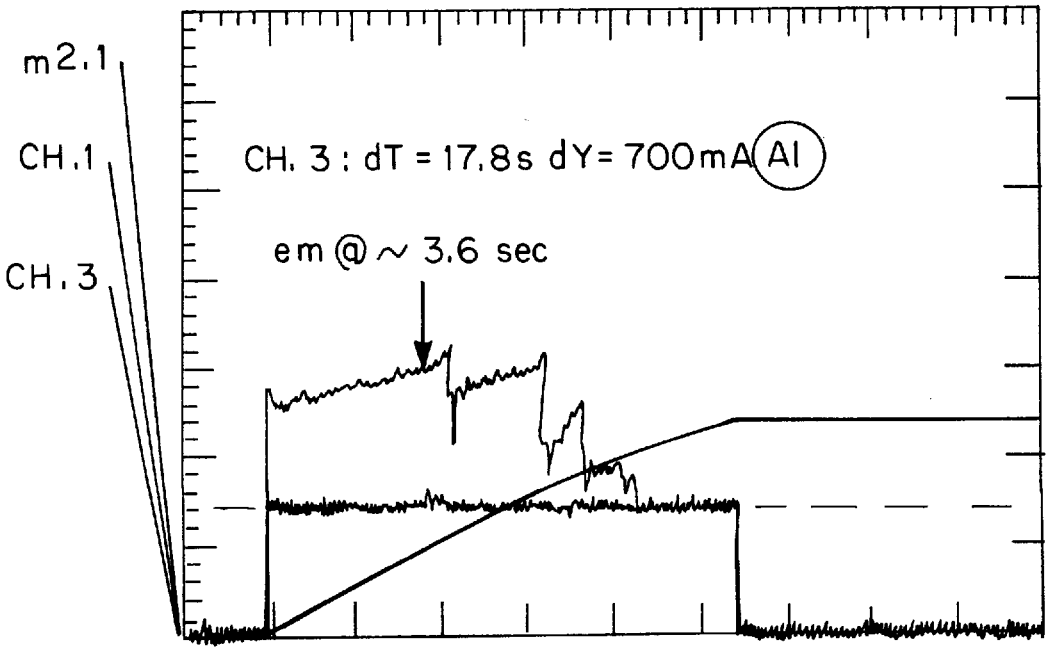
FIG. 5 is a chart showing the no-fire electrical characteristics of a prior art semiconductor bridge device utilizing aluminum lands.

For the no-fire test, the Type A and Type B units were placed in a holding fixture electrically connected to the power supply that delivered a constant current pulse. An electrical current of about 700 milliamps ("mA") was selected and voltage probes were attached to the terminals of the devices and to an oscilloscope. Current was measured from the voltage drop across a current viewing resistor of 0.105 ohm connected in series with the igniter of the unit. Voltage was directly measured across the semiconductor bridge. Power was calculated as the product of voltage times current, and energy as the time-integrated power. To carry out the no-fire test, a constant current pulse was passed through the type A and Type B units and the electrical and thermal response of the devices were independently measured. Both the Type A and Type B devices had the same initial conditions and were tested under exactly the same procedures (1.00 ohm at an ambient temperature of 27° C., the same bridge size, and the same current level). The electrical responses were recorded with an oscilloscope and they are shown in FIGS. 4 and 5, each of which shows traces representing the constant current level, voltage, power and energy. FIG. 4 represents the electrical response of the Type A devices comprising an embodiment of the present invention, whereas FIG. 5 represents the electrical response of the Type B devices comprising prior art devices. The important feature to observe in FIGS. 4 and 5 is the voltage trace that indirectly gives a measure of the electrical resistance of the devices and, therefore of its temperature. In FIG. 4, the maximum voltage measured for the Type A unit at the end of the 5 minutes pulse was about 1.35 volts, whereas in FIG. 5 a voltage value of about 1.10 volts was high enough to produce melting and electromigration of the aluminum in the comparative Type B unit at about 3.5 seconds.

FIG. 6, which is more fully described below, shows the appearance of the bridge of a Type B prior art device after the no-fire test, which caused aluminum electromigration in the form of melted filaments that shorted out and dudded the device.

All-Fire Test

The all-fire test was applied to several Type A and Type B devices, specifically the SCB part number 51B1, with the purpose of determining reproducibility of function times and energy levels. The firing of these devices consisted of discharging a high capacitor value of 21 millifarads ("mF"), initially charged to about 4.18 volts, through the semiconductor bridge device. In other words, the capacitor voltage was maintained the same for all tested devices.

Function time ("$t_f$") and total energy needed for the bridge consumption ("$E(t_f)$")were obtained from the electrical signature of the devices during their operation. Average values for $t_f$ were 7.24 $\mu$sec and for $E(t_f)$ were 85.3 $\mu$J, with standard deviations of 1.007 $\mu$sec and 9.32 $\mu$J, respectively, for device Type A fabricated with the present invention.

These values represent the average results from testing ten different semiconductor bridge devices and indicate a shorter $t_f$ and a lower $E(t_f)$ values than those obtained with Al-based, Type B prior art, units of a value of tf of 10 $\mu$sec and of $E(t_f)$ of 120 $\mu$J, respectively.

Threshold Level

Semiconductor bridge devices of Type A in accordance with an embodiment of the present invention, and Type B prior art devices were also characterized in terms of their minimum voltage (threshold level) for firing. A low voltage capacitor (50 $\mu$F) discharge firing set was used to fire the devices by stepping the voltage from a no-go to a go situation (i.e., between a no-firing and a firing voltage) until the voltage difference to separate the two cases (no-fire and fire) was at a minimum, about 0.2 volts.

From this test it was found that a voltage value of 3.75 volts corresponded to the threshold level in air for Type A devices with the 50 $\mu$F capacitor discharge unit. This value is approximately 20% lower than that obtained for Al-based SCBs or Type B prior art devices tested in air and under the same conditions, i.e., on TO46 headers and brass charge holders and wire bonded with 5 mil aluminum wires, as shown in FIG. 7.

FIG. 6 shows the results of electromigration of aluminum from aluminum lands, which is typical of what occurs with aluminum lands in Type B prior art devices which are subjected to a no-fire test in excess of about 3 to 5 seconds. In FIG. 6, 16*a*′ and 16*b*′ are aluminum metallized lands and 14*c*′ is the top surface of the initiator bridge area. A portion of the electrically non-conducting pad 14*b*′ is visible at the right-hand side of FIG. 6 and M1 and M2 show tendril-like growths of aluminum, resulting from electromigration of aluminum across bridge 14*c*′ between lands 16*a*′ and 16*b*′. The masses M1 and M2 provide a direct path of electrical conductivity between metallized lands 16*a*′ and 16*b*′, thereby short-circuiting initiator bridge 14*c*′ and impairing the performance of, or rendering inoperative, the semiconductor bridge device of FIG. 6. The migration of the aluminum masses M1 and M2 over the bridge results in a very low impedance state, i.e., a short circuit, that drastically reduces the heating rate of the initiator bridge 14*c*′, which heating rate is proportional to $I^2R$ and may result in a non-fire or dud semiconductor bridge igniter. The susceptibility of aluminum metallized lands to electromigration is particularly severe when the semiconductor bridge igniters are to be used in applications where high current, relatively long duration no-fire safety tests, and very low firing voltage or current levels are needed, such as is encountered in the automotive, ammunition and entertainment (pyrotechnics) fields. The prior art aluminum metallized land semiconductor bridge devices cannot sustain such severe no-fire tests and very low firing current or voltage levels because of the tendency of the aluminum to melt at relatively low temperatures and migrate over the bridge (as illustrated in FIG. 6) as the bridge heats up in preparation for firing.

As will be apparent from the test data described above and illustrated in FIGS. 4 and 5, the titanium/titanium-tungsten/tungsten multilayer metallized lands utilized in the devices of the present invention provide improved overall characteristics including all-fire and no-fire tests by avoiding the problems inherent in the use of aluminum lands.

While the present invention has been described in detail with respect to a specific embodiment thereof, it will be appreciated by those skilled in the art that upon a reading and understanding of the foregoing numerous variations may be made to the illustrated embodiments which variations nonetheless lie within the spirit and scope of the appended claims.

What is claimed is:

1. A semiconductor bridge device comprising:

an electrically non-conducting substrate;

an electrically-conducting material deposited on the substrate and having a temperature coefficient of electrical resistivity which is negative at a given temperature above about 20° C. and below about 1400° C. the material defining a bridge connecting a pair of spaced-apart pads, the bridge and the pads being so dimensioned and configured that passage therethrough of an electrical current of selected characteristics releases energy at the bridge;

a pair of spaced-apart metallized lands each being of planar, plate-like configuration and one being disposed on each of the spaced-apart pads but leaving at least a portion of the bridge uncovered, each of the metallized lands comprising (i) a base layer comprised of titanium and disposed upon its associated pad, (ii) an intermediate layer comprised of titanium and tungsten and disposed on its associated base layer, and (iii) a top layer comprised of tungsten and disposed on its associated intermediate layer; and an electrical conductor connected to each of the metallized lands for passing an electrical current of the selected characteristics through the bridge.

2. The device of claim 1 wherein the surface area of the spaced-apart pads is sufficiently greater than the surface area of the bridge whereby the electrical resistance across the pads is substantially determined by the bridge.

3. The device of claim 2 comprising an explosive-initiating device and dimensioned and configured to release at the bridge upon the passage of the electrical current therethrough at least sufficient energy to initiate an explosive placed in contact with the bridge.

4. The device of claim 1 comprising an explosive-initiation device and dimensioned and configured to release at the bridge upon the passage of the electrical current therethrough at least sufficient energy to initiate an explosive placed in contact with the bridge.

5. The device of any one of claims 1, 2, 3 or 4 wherein the electrically non-conducting substrate is selected from the group consisting of sapphire, silicon dioxide on silicon and silicon nitride on silicon.

6. The device of any one of claims 1, 2, 3 or 4 wherein the electrically-conducting material comprises a semiconductor.

7. The device of claim 6 wherein the semiconductor material comprises a doped semiconductor.

8. The device of claim 6 wherein the electrically non-conducting substrate is selected from the group consisting of sapphire, silicon dioxide on silicon and silicon nitride on silicon.

9. The device of claim 6 wherein the semiconductor material is selected from the group consisting of monocrystalline silicon, polycrystalline silicon and amorphous silicon.

10. The device of any one of claims 1, 2, 3 or 4 wherein the electrical resistance of the bridge is less than ten ohms.

11. The device of any one of claims 1, 2, 3 or 4 wherein the electrical resistance of the bridge is less than three ohms.

12. The device of any one of claims 1, 2, 3 or 4 wherein the metallized lands completely cover their associated spaced-apart pads.

13. The device of claim 3 or claim 4 further comprising an explosive material disposed in contact with the initiation bridge.

14. An explosive initiating device comprising:

an electrically non-conducting substrate;

a semiconductor material deposited on the substrate and having a temperature coefficient of electrical resistivity which is negative at a given temperature above about 20° C. and below about 1400° C., the semiconductor material defining an initiation bridge connecting a pair of spaced-apart pads, the bridge and the pads being so dimensioned and configured that passage therethrough of an electrical current of selected characteristics releases at the bridge sufficient energy to initiate an explosive placed in contact with the bridge, the surface area of the spaced-apart pads being sufficiently greater than the surface area of the bridge whereby the electrical resistance across the pads is substantially that of the bridge;

a pair of metallized lands, each being of planar, plate-like configuration and one being disposed on a respective one of the spaced-apart pads while leaving at least a portion of the bridge uncovered, the metallized lands each comprising (i) a base layer comprised of titanium and disposed upon a respective one of the spaced-apart pads, (ii) an intermediate layer comprised of titanium and tungsten and disposed on a respective one of the base layers, and (iii) a top layer comprised of tungsten and disposed on a respective one of the intermediate layers; and an electrical conductor connected to each of the metallized lands for passing an electrical current of the selected characteristics through the bridge.

15. The device of claim 14 further including an explosive disposed in contact with the bridge.

16. The device of claim 14 or claim 15 further comprising a housing enclosing the substrate, the semiconductor material and the metallized lands and comprising a receptacle within which the explosive is received.

17. The device of claim 14 or claim 15 wherein the electrically non-conducting substrate is selected from the group consisting of sapphire, silicon dioxide on silicon and silicon nitride on silicon.

18. The device of claim 14 or claim 15 wherein the semiconductor material is selected from the group consisting of monocrystalline silicon, polycrystalline silicon and amorphous silicon.

19. The device of any one of claims 1, 2, 14 or 15 wherein the intermediate layer comprises from about 20 to 80 percent by weight titanium and from about 80 to 20 percent by weight tungsten.

20. The device of claim 19 wherein the base layer consists essentially of titanium and the top layer consists essentially of tungsten.

21. The device of any one of claims 1, 2, 14 or 15 wherein the base layer is from about 50 to 350 Angstroms in thickness, the intermediate layer is from about 50 to 200 Angstroms in thickness and the top layer is from about 0.7 to 1.5 microns in thickness.

22. The device of any one of claims 1, 2, 14 or 15 wherein the metallized lands are deposited by metal sputtering.

23. A method of making a semiconductor bridge device comprising depositing on an electrically non-conducting substrate an electrically-conducting material having a temperature coefficient of electrical resistivity which is negative at a given temperature above about 20° C. and below about 1400° C., the electrically-conducting material defining a bridge connecting a pair of spaced-apart pads, the bridge and the pads being so dimensioned and configured that passage therethrough of an electrical current of selected characteristics releases energy at the bridge;

depositing a stratified metal layer over at least each of the spaced-apart pads by (i) depositing a base layer comprised of titanium upon the electrically conducting material, (ii) depositing an intermediate layer comprised of titanium and tungsten upon the base layer, and (iii) depositing a top layer comprised of tungsten upon the intermediate layer;

forming a metallized land over each of the spaced-apart pads; and connecting an electrical conductor to each of the metallized lands for passing an electrical current of the selected characteristics through the bridge.

24. The method of claim 23 including depositing the stratified metal layer over only each of the spaced-apart pads to form a pair of spaced-apart metal lands while leaving at least a portion of the bridge uncovered.

25. The method of claim 23 including depositing the stratified layer over the electrically-conducting material including both the bridge and the pads, providing the tungsten top layer in a thickness greater than that required for a desired resistivity of the bridge, and thereafter reducing the thickness of the top layer over the bridge only to a reduced thickness to provide a desired bridge resistivity and a pair of spaced-apart tungsten lands.

26. The method of claim 23, claim 24 or claim 25 including depositing the metallized lands by metal sputtering.

27. The method of claim 23, claim 24 or claim 25 including depositing a semiconductor as the electrically-conducting material.

28. The method of claim 27 including depositing a doped semiconductor as the electrically-conducting material.

29. The method of claim 23, claim 24 or claim 25 wherein the electrically non-conducting substrate is selected from the group consisting of sapphire, silicon dioxide on silicon, and silicon nitride on silicon.

30. The method of claim 23, claim 24 or claim 25 wherein the semiconductor material is selected from the group consisting of monocrystalline silicon, polycrystalline silicon and amorphous silicon.

31. The method of claim 23, claim 24 or claim 25 including depositing a combination of from about 20 to 80 percent by weight titanium and from about 80 to 20 percent by weight tungsten as the intermediate layer.

32. The method of claim 31 including depositing as the base layer a metal consisting essentially of titanium and depositing as the top layer a metal consisting essentially of tungsten.

33. The method of claim 23, claim 24 or claim 25 including depositing the base layer to a thickness of from about 50 to 350 Angstroms, depositing the intermediate layer to a thickness of from about 50 to 200 Angstroms and depositing the top layer to a thickness of from about 0.7 to 1.5 microns.

34. The method of claim 23, claim 24 or claim 25 including placing an explosive in contact with the bridge.

35. The device of any one of claims 1, 2, 3 or 4 wherein the bridge and the pads are covered by a stratified metal layer comprising (i) a base layer comprised of titanium and disposed upon the bridge and pads, (ii) an intermediate layer comprised of titanium and tungsten and disposed on the base layer, and (iii) a top layer comprised of tungsten and disposed on the intermediate layer.

36. A hybrid bridge device comprising:

an electrically non-conducting substrate;

an electrically-conducting material deposited on the substrate and having a temperature coefficient of electrical resistivity which is negative at a given temperature above about 20° C. and below about 1400° C., the material defining a bridge connecting a pair of spaced-apart pads, the bridge and the pads being so dimensioned and configured that passage therethrough of an electrical current of selected characteristics releases energy at the bridge;

a pair of spaced-apart metallized lands each being of planar, plate-like configuration and one being deposited on each of the spaced-apart pads but leaving at least a portion of the bridge uncovered, the metallized lands each comprising a stratified metal layer comprising (i) a base layer comprised of titanium and disposed upon the electrically-conducting material, (ii) an intermediate layer comprised of titanium and tungsten and disposed on the base layer, and (iii) a top layer comprised of tungsten and disposed on the intermediate layer; and an electrical conductor connected to each of the metallized lands for passing an electrical current of the selected characteristics through the bridge.

* * * * *